US006490884B2

(12) United States Patent
Schoenecker et al.

(10) Patent No.: US 6,490,884 B2
(45) Date of Patent: Dec. 10, 2002

(54) PROCESS AND DEVICE FOR PRODUCTION OF OXYGEN AND NITROGEN

(75) Inventors: Herbert Schoenecker, Ebenhausen (DE); Jurgen Voit, Schondorf (DE)

(73) Assignee: Linde AG, Weisbaden (DE)

( * ) Notice: Subject to any disclaimer, the term of this patent is extended or adjusted under 35 U.S.C. 154(b) by 0 days.

(21) Appl. No.: 09/990,365

(22) Filed: Nov. 23, 2001

(65) Prior Publication Data

US 2002/0062658 A1 May 30, 2002

(30) Foreign Application Priority Data

Nov. 24, 2000 (DE) ..... 100 58 332

(51) Int. Cl.[7] ..... F25J 3/04
(52) U.S. Cl. ..... 62/650
(58) Field of Search ..... 62/617, 640, 643, 62/650

(56) References Cited

U.S. PATENT DOCUMENTS 4,439,220 A * 3/1984 Olszewski et al. ..... 62/31
4,832,719 A 5/1989 Erickson
5,006,139 A * 4/1991 Agrawal et al. ..... 62/24
5,137,559 A 8/1992 Agrawal
5,682,762 A * 11/1997 Agrawal et al. ..... 62/643
5,697,229 A * 12/1997 Agrawal et al. ..... 62/643
6,196,022 B1 * 3/2001 Horst et al. ..... 62/643

FOREIGN PATENT DOCUMENTS

EP 1 022 530 7/2000

OTHER PUBLICATIONS

European Search Report dated Mar. 15, 2002.

* cited by examiner

*Primary Examiner*—William C. Doerrler
*Assistant Examiner*—Malik N. Drake
(74) *Attorney, Agent, or Firm*—Millen, White, Zelano & Branigan, P.C.

(57) ABSTRACT

Oxygen and nitrogen are produced by low-temperature separation of air in a rectification system that has a pressure column (4) and a low-pressure column (5). Charging air (1, 3) is introduced into pressure column (4). An oxygen-containing liquid fraction (8, 10) is removed from pressure column (4) and fed into low-pressure column (5). Gaseous nitrogen (17) from low-pressure column (5) is at least partially condensed in a top condenser (7) by indirect heat exchange with an evaporating cooling fluid (15). A nitrogen product stream (19) is removed from low-pressure column (5) and/or pressure column (4). An oxygen product stream (61, 62, 63) is pulled off from low-pressure column (5). The cooling fluid for top condenser (7) of low-pressure column (5) is formed by an intermediate liquid (15) that is drawn off from an intermediate point on low-pressure column (5).

19 Claims, 1 Drawing Sheet

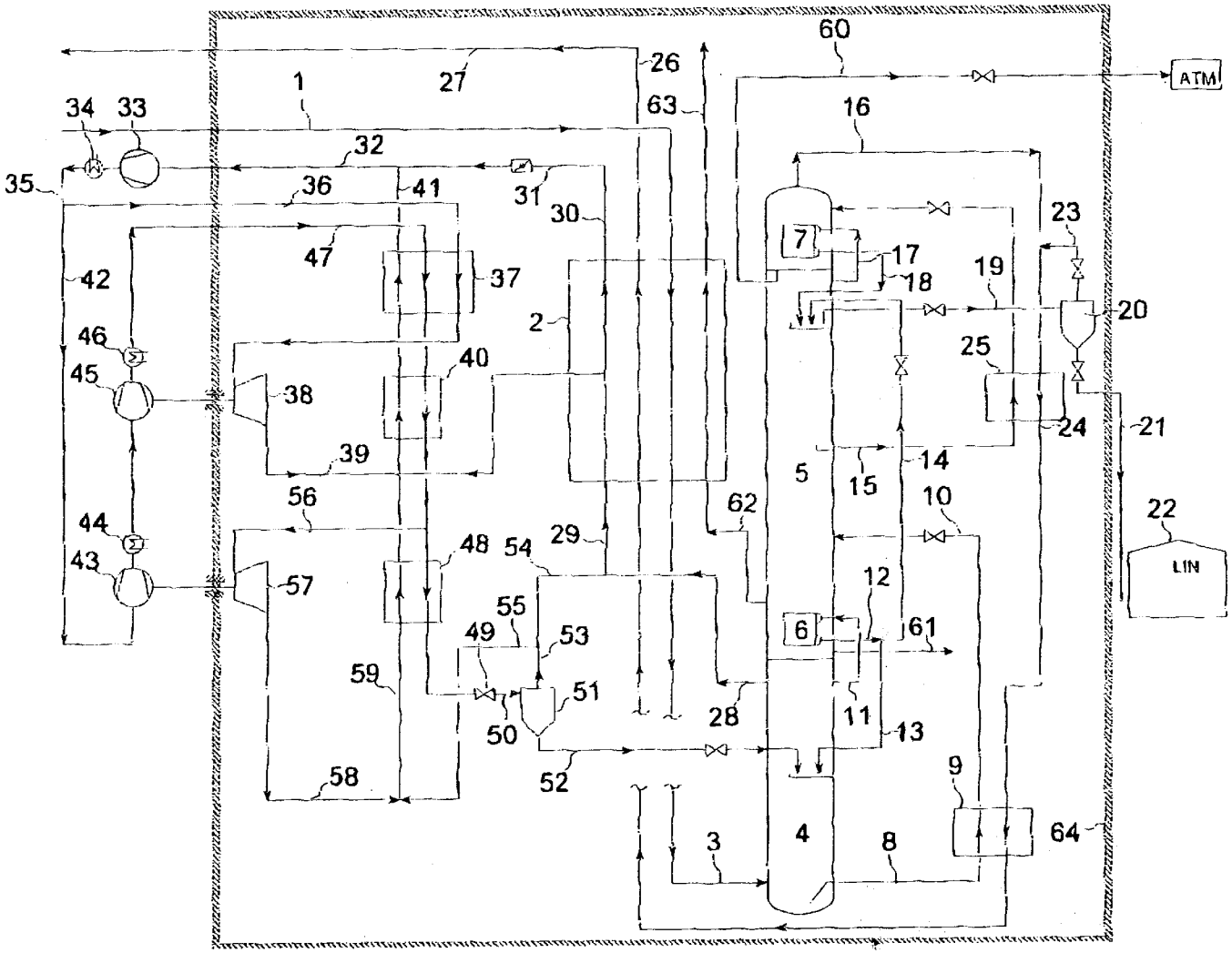
ATM
LIN

PROCESS AND DEVICE FOR PRODUCTION OF OXYGEN AND NITROGEN

BACKGROUND OF THE INVENTION

The invention relates to a process for the production of oxygen and nitrogen by low-temperature (cryogenic) separation of air in a rectification system that has a high-pressure column and a low-pressure column, whereby in the process, charging air is introduced into the high-pressure column, an oxygen-containing liquid fraction is removed from the high-pressure column and fed into the low-pressure column, gaseous nitrogen from the low-pressure column is at least partially condensed in a top condenser by indirect heat exchange with an evaporating cooling fluid, a nitrogen product stream is removed from the low-pressure column and/or the high-pressure column, and an oxygen product stream is pulled off from the low-pressure column.

Processes with top cooling of the low-pressure column are known from EP 1022530 A1, WO 9819122 or EP 811816 A2. A process of the type mentioned above is shown in EP 955509 A1.

SUMMARY OF THE INVENTION

An object of the invention is to provide a process of the type mentioned above, as well as corresponding apparatus therefor, which works especially efficiently.

Upon further study of the specification and appended claims, further objects and advantages of this invention will become apparent to those skilled in the art.

These objects are achieved through the use of an intermediate liquid, that is drawn from an intermediate point on the low-pressure column, as the cooling fluid for the top condenser of the low-pressure column.

In EP 955509 A1, the cooling liquid for the top condenser of the low-pressure column is formed from the bottom liquid of the high-pressure column. In comparison to this, the invention has two advantages. On the one hand, the composition of the cooling fluid can be selected such that the product yield, especially the oxygen yield, is increased. On the other hand, the cooling fluid has a lower pressure, so that before its introduction into the top condenser, it has to be throttled only relatively slightly (e.g., 1.7 to 3 bar); the flash gas losses are correspondingly smaller.

To optimize the oxygen yield, it is advantageous if the intermediate liquid, which is used as cooling fluid in the top condenser, is drawn off from an intermediate point that lies above the point at which the oxygen-containing liquid fraction is fed from the high-pressure column into the low-pressure column. For example, 10 to 20 theoretical plates or 12 to 25 actual plates lie between them.

In the process, liquid nitrogen can be drawn off from the low-pressure column or from its top condenser and can be pulled off as liquid nitrogen product. In particular in this case, the process preferably has a nitrogen circuit. In this case, the circuit nitrogen is drawn off in gaseous form from the upper area of the high-pressure column and is compressed in a circuit compressor, whereby a first partial stream of the compressed circuit nitrogen is actively depressurized, and a second partial stream of the compressed circuit nitrogen is liquefied and fed back into the rectification system and/or is removed as another liquid nitrogen product. Such a circuit can also be used without oxygen production, for example with use of the bottom liquid of the low-pressure column or high-pressure column as a cooling fluid in the top condenser of the low-pressure column.

Cold is produced by the active depressurization of the first partial stream of the circuit nitrogen, and said cold is further transported via the liquefied second partial stream and can be used to increase the liquid production. The liquid from the circuit can be drawn off directly, for example, as liquid nitrogen product. As an alternative or in addition, the liquefied circuit nitrogen can be fed to one of the columns of the rectification system, preferably the high-pressure column. The corresponding amount can then be drawn off from the rectification system as liquid nitrogen and/or oxygen product.

Top nitrogen of the high-pressure column is liquefied in a main condenser. The condensate that is produced in this case is released at least in part, preferably for the most part, as reflux to the high-pressure column. Another portion of the condensate can be introduced into the low-pressure column above and/or drawn off immediately as liquid nitrogen product.

The circuit can be designed as a two-turbine or multi-turbine system by having a third partial stream of the compressed circuit nitrogen be actively depressurized independently of the first partial stream.

In addition, the invention relates to a device according to an apparatus for production of oxygen and nitrogen by low-temperature (cryogenic) separation of air comprising:

(a) a rectification system having a high-pressure column (4) and a low-pressure column (5), (b) (b) a feed line (1, 3) for introducing feed air into the high-pressure column (4), (c) (c) a liquid line (8, 10) for transferring an oxygen-containing liquid fraction from the high-pressure column (4) into the low-pressure column (5), (d) (d) a top condenser (7) having a liquefaction chamber which is in fluid communication (17, 18) with the upper section of said low-pressure column (5) and the top condenser having an evaporation chamber which is in fluid communication with a coolant line (15) for introducing a cooling fluid, (e) a nitrogen-product line (19) which is connected to the low-pressure column (5) and/or the high-pressure column (4), and (f) an oxygen-product line (61, 62, 63) which is connected to the low-pressure column (5), wherein the coolant line (15) is connected to an intermediate point (15) on the low-pressure column (5).

BRIEF DESCRIPTION OF THE DRAWINGS

Various other features and attendant advantages of the present invention will be more fully appreciated as the same becomes better understood when considered in conjunction with the accompanying drawing, FIG. 1, which illustrates an embodiment of the invention.

DERAILED DESCRIPTION OF THE DRAWING

Compressed and purified feed air flows through line 1 into a main heat exchanger 2 and is cooled there to approximately dew point. Via line 3, the cold air is fed to high-pressure column 4 of the rectification system, which comprises high-pressure column 4, low-pressure column 5, main condenser 6 and top condenser 7.

An oxygen-containing liquid fraction (8) from the bottom of the high-pressure column is cooled in a sub-cooler 9 and introduced via line 10 into an intermediate point in low-pressure column 5.

At the top of high-pressure column 4, gaseous top nitrogen is at least partially, preferably completely, liquefied in a first portion 11 in main condenser 6. Condensate 12 that is produced in this case is returned as reflux in a first portion 13 to the top of high pressure column 4. A second portion 14 of the nitrogen condensate 12 is introduced into the low-pressure column.

From the bottom of the low-pressure column, which simultaneously represents the evaporation chamber of main condenser 6, a liquid oxygen product stream 61 is drawn off. A residual amount 62 of oxygen is removed in gaseous form from the lower portion of the low-pressure column, heated in main heat exchanger 2 and finally removed via line 63 as product for the consumer. In the example, the oxygen product from the low-pressure column is mainly removed in liquid form; as an alternative or in addition, an oxygen product stream can be removed in gaseous form from the low-pressure column. When liquid is drawn off, the product—optionally after sub-cooling—can be used in liquid form and/or the liquid can be evaporated—for example under elevated pressure—to be provided in gaseous form. Such evaporation can be performed by indirect heat exchange (side condenser or internal compression) or direct heat exchange (mixing column).

From an intermediate point on low-pressure column 5, which in the example is twelve actual plates or nine theoretical plates above the feed point of bottom liquid 10 into the high-pressure column, a cooling fluid 15 is drawn off in liquid form, sub-cooled (25) and fed into the evaporation chamber of top condenser 7 of the low-pressure column. There it evaporates off completely, except for a small scavenger amount 60, and is removed via line 16 as a residual gas. In the liquefaction chamber of top condenser 7, gaseous nitrogen 17 from the top of the low-pressure column is at least partially, preferably completely, liquefied and fed via line 18 into low-pressure column 5.

At the top of the low-pressure column, liquid nitrogen 19 is drawn off, and after flash gas is separated in a separator 20, it is drawn off via line 21 as a liquid nitrogen product and introduced into a tank 22. Flash gas 23 is mixed in with residual gas 16. The resultant residual mixture 24 is heated in sub-coolers 25, 9 and in main heat exchanger 2, and finally is discharged into the atmosphere via line 27 and/or is used as a regenerating gas for a purification stage (not shown) for the feed air.

Circuit nitrogen is removed from the top of the high-pressure column via line 28, heated (29) in main heat exchanger 2 to about ambient temperature and introduced via lines 30, 31, 32 to the inlet of a circuit compressor 33. (This high-pressure column nitrogen 28 preferably represents the single feed into the nitrogen circuit; a feed gas compressor for introducing low-pressure nitrogen into the circuit thus can be eliminated.) Downstream from a secondary condenser 34, a first partial stream 36 of compressed circuit nitrogen 35 is separated, cooled in a first circuit heat exchanger 37 to a first intermediate temperature and actively depressurized in a hot turbine 38. Exhaust gas 39 from hot turbine 38 is further heated in a second circuit heat exchanger 40 and in a first circuit heat exchanger 37 and recycled to circuit compressor 33 (lines 41, 32).

Via line 42, a second partial stream of the compressed circuit nitrogen is run through two secondary compressors 43, 45 that are connected in series, followed in each case by a secondary condenser 44, 46. The second partial stream further flows into first circuit heat exchanger 37 (via line 47), is further cooled in second circuit heat exchanger 40 and finally is liquefied in third circuit heat exchanger 48 or is pseudo-liquefied in the case of supercritical pressure. After depressurization to approximately the pressure of the high-pressure column in a butterfly valve 49, liquefied second partial stream 50, 52—after separation of gaseous components in a separator 51—is introduced (52) into high-pressure column 4. Flash gas 53 from separator 51 is recycled via lines 54 and/or 55 to circuit compressor 33.

A third partial stream of the compressed circuit nitrogen is run together with the second partial stream through secondary condensers 43, 45 and first and second circuit heat exchangers 37, 40. At a second intermediate temperature, which is lower than the first intermediate temperature, third partial stream 56 is run to a cold turbine 57. The actively depressurized third partial stream flows back via line 58 through three circuit heat exchangers 48, 40, 37 to the inlet of the circuit compressor 33.

The cold portions of the unit are arranged in an insulating housing (Coldbox) 64.

Various modifications are conceivable in the embodiment. If no oxygen product is desired, bottom liquid 8, 10 from high-pressure column 4 can also be introduced directly above the bottom into low-pressure column 5, which simultaneously represents the evaporation chamber of main condenser 6. In this case, cooling fluid 15 for top condenser 7 would be drawn off either from the bottom of the low-pressure column or would be diverted directly from pressure-column-bottom liquid 10.

The entire disclosure of all applications, patents and publications, cited above and below, and of corresponding German Application No. 100 58 332.6 filed Nov. 24, 2000 is hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for production of oxygen and nitrogen by low-temperature separation of air in a rectification system which comprises a high-pressure column (4) and a low-pressure column (5), said process comprising:

feeding air (1, 3) into a high-pressure column (4), removing an oxygen-containing liquid fraction (8, 10) from said high-pressure column(4) and feeding said oxygen-containing liquid fraction into said low-pressure column (5), at least partially condensing gaseous nitrogen (17) from low-pressure column (5) in a top condenser (7) of said low-pressure column by indirect heat exchange with an evaporating cooling fluid (15), removing a nitrogen product stream (19) from said low-pressure column (5) said pressure column (4), and removing an oxygen product stream (61, 62, 63) in liquid form, gaseous form, or both, from said low-pressure column (5), wherein said cooling fluid for said top condenser (7) of said low-pressure column (5) is formed by an intermediate liquid (15) removed from an intermediate point on said low-pressure column (5), wherein said intermediate point is above the point at which said oxygen-containing liquid fraction (8, 10) from said high-pressure column (4) is introduced into said low-pressure column (5), and said intermediate point is below the point at which said nitrogen product stream (19) is removed from said low-pressure column (5).

2. A process according to claim 1, wherein said liquid nitrogen (19) removed off from said low-pressure column (5) or a liquid nitrogen fraction removed top condenser (7) of said low-pressure column is discharged as liquid nitrogen product (22).

3. A process according to claim 2, wherein circuit nitrogen (28, 29, 30, 31, 32) is removed in gaseous form from the upper section of said high-pressure column (4) and is compressed in a circuit compressor (33), whereby a first partial stream (36) of compressed circuit nitrogen is actively depressurized (38), a second partial stream (42, 47, 50) of compressed circuit nitrogen is liquefied and is fed (52) into said rectification system and/or is removed as liquid nitrogen product.

4. A process according to claim 3, wherein top nitrogen (11) removed from a said high-pressure column (4) is liquefied in a main condenser (6).

5. A process according to claim 2, wherein top nitrogen (11) removed from a said high-pressure column (4) is liquefied in a main condenser (6).

6. A process according to claim 1, wherein circuit nitrogen (28, 29, 30, 31, 32) is removed in gaseous form from the upper section of said high-pressure column (4) and is compressed in a circuit compressor (33), whereby a first partial stream (36) of compressed circuit nitrogen is actively depressurized (38), and a second partial stream (42, 47, 50) of compressed circuit nitrogen is liquefied and is fed (52) into said rectification system and/or is removed as liquid nitrogen product.

7. A process according to claim 6, wherein top nitrogen (11) removed from a said high-pressure column (4) is liquefied in a main condenser (6).

8. A process according to claim 1, wherein top nitrogen (11) removed from said high-pressure column (4) is liquefied in a main condenser (6).

9. A process according to claim 8, wherein condensate (12) formed in said main condenser is at least partially (14) introduced into said low-pressure column.

10. A process according to claim 9, wherein condensate (12) formed in said main condenser is at least partially discharged as a liquid nitrogen product (22).

11. A process according to claim 8, wherein condensate (12) formed in said main condenser is at least partially discharged as a liquid nitrogen product (22).

12. A process according to claim 1, wherein before being introduced into the top condenser, the cooling fluid is throttled 1.7 to 3 bar.

13. A process according to claim 1, wherein between said intermediate point and the point at which the oxygen-containing liquid fraction is fed into said high-pressure column there are 10–20 theoretical plates.

14. A process according to claim 1, wherein between said intermediate point and the point at which the oxygen-containing liquid fraction is fed into said high-pressure column there are 12–25 actual plates.

15. An apparatus for production of oxygen and nitrogen by low-temperature (cryogenic) separation of air comprising:

(a) a rectification system having a high-pressure column (4) and a low-pressure column (5), (b) a feed line (1, 3) for,,introducing feed air into said high-pressure column (4), (c) a liquid line (8, 10) for transferring an oxygen-containing liquid fraction from said high-pressure column (4) into said low-pressure column (5), (d) a top condenser (7) having a liquefaction chamber which is in fluid communication (17, 18) with the upper section of said low-pressure column (5) and said top condenser having an evaporation chamber which is in fluid communication with a coolant line (15) for introducing a cooling fluid, (e) a nitrogen-product line (19) which is connected to said low-pressure column (5) said high-pressure column (4), or both, and (f) an oxygen-product line (61, 62, 63) which is connected to said low-pressure column (5), wherein said coolant line (15) is connected to an intermediate point (15) on said low-pressure column (5), wherein said intermediate point is above the point at which a liquid line (8, 10) for transferring an oxygen-containing liquid fraction from said high pressure column (4) is connected to said low-pressure column (5), and said intermediate point is below the point at which said nitrogen product stream (19) is removed from said low-pressure column (5).

16. An apparatus according to claim 15, wherein between said intermediate point and the point at which the oxygen-containing liquid fraction is fed into said high-pressure column there are 10–20 theoretical plates.

17. An apparatus according to claim 15, wherein between said intermediate point and the point at which the oxygen-containing liquid fraction is fed into said high-pressure column there are 12–25 actual plates.

18. A process for production of oxygen and nitrogen by low-temperature separation of air in a rectification system which comprises a high-pressure column (4) and a low-pressure column (5), said process comprising:

feeding air (1, 3) into a high-pressure column (4), removing an oxygen-containing liquid fraction (8, 10) from said high-pressure column (4) and feeding said oxygen-containing liquid fraction into said low-pressure column (5), at least partially condensing gaseous nitrogen (17) from low-pressure column (5) in a top condenser (7) of said low-pressure column by indirect heat exchange with an evaporating cooling fluid (15), removing a nitrogen product stream (19) from said low-pressure column (5), said pressure column (4), or both, and removing an oxygen product stream (61, 62, 63) in liquid form, gaseous form, or both, from said low-pressure column (5), wherein said cooling fluid for said top condenser (7) of said low-pressure column (5) is formed by an intermediate liquid (15) removed from an intermediate point on said low-pressure column (5), wherein said intermediate point is above the point at which said oxygen-containing liquid fraction (8, 10) from said high-pressure column (4) is introduced into said low-pressure column (5), and wherein top nitrogen removed from said high-pressure column is liquefied in a main condenser and condensate from said main condenser is at least partially introduced into said low-pressure column.

19. An apparatus for production of oxygen and nitrogen by low-temperature (cryogenic) separation of air comprising:

(a) a rectification system having a high-pressure column (4) and a low-pressure column (5), (b) a feed line (1, 3) for introducing feed air into said high-pressure column (4), (c) a liquid line (8, 10) for transferring an oxygen-containing liquid fraction from said high-pressure column (4) into said low-pressure column (5), (d) a top condenser (7) having a liquefaction chamber which is in fluid communication (17, 18) with the upper section of said low-pressure column (5) and said top condenser having an evaporation chamber which is in fluid communication with a coolant line (15) for introducing a cooling fluid, wherein said coolant line (15) is connected to an intermediate point (15) on said low-pressure column (5) and said intermediate point is above the point at which a liquid line (8, 10) for transferring an oxygen-containing liquid fraction from said high pressure column (4) is connected to said low-pressure column (5), (e) a nitrogen-product line (19) which is connected to said low-pressure column (5), said high-pressure column (4), or both, (f) an oxygen-product line (61, 62, 63) which is connected to said low-pressure column (5), (g) a top nitrogen line for removing nitrogen from said high-pressure column, and (h) a main condenser in fluid communication with said top nitrogen line for liquefying top nitrogen from said high-pressure to form a condensate and a nitrogen line in fluid communication with said main condenser and said low-pressure column for delivering at least of the condensate to said low-pressure column.

* * * * *